US005435437A

United States Patent [19]

Sasaki

[11] Patent Number: 5,435,437

[45] Date of Patent: Jul. 25, 1995

[54] DEVICE-ACCOMMODATING BOX

[75] Inventor: Hiroaki Sasaki, Yokohama, Japan

[73] Assignee: Canon Kabushiki Kaisha, Tokyo, Japan

[21] Appl. No.: 184,050

[22] Filed: Jan. 21, 1994

[30] Foreign Application Priority Data

Jan. 29, 1993 [JP] Japan ..... 5-013729

[51] Int. Cl.[6] ..... B65D 51/04

[52] U.S. Cl. ..... 206/45.23; 206/305; 206/320; 206/813

[58] Field of Search ..... 206/45.2, 45.21, 45.22, 206/45.23, 45.24, 45.25, 305, 320, 6.1, 373, 372, 813; 224/901

[56] References Cited

U.S. PATENT DOCUMENTS 2,695,097 11/1954 Easton ..... 206/45.21

3,088,738 5/1963 Meyer ..... 206/45.2

4,651,872 3/1987 Joyce ..... 206/45.23 X 4,765,462 8/1988 Rose, Jr. ..... 206/45.2 X

*Primary Examiner*—Jacob K. Ackun

*Attorney, Agent, or Firm*—Fitzpatrick, Cella, Harper & Scinto

[57] ABSTRACT

A device-accommodating box suitable for accommodating a conversation machine for physically handicapped people, or the like, in which the surface upon which the accommodated device is operated is easily tilted by utilizing a lid so that the device-accommodating portion can be secured stably. Pivotally hinged inside and outside lids are arranged to be overlapped with each other on the device-accommodating portion. Thus, the accommodating portion can be secured at different angles by combining the inside and outside lids at various degrees of pivoting.

5 Claims, 5 Drawing Sheets

DEVICE-ACCOMMODATING BOX

BACKGROUND OF THE INVENTION

Field of the Invention

The present invention relates to a device-accommodating box, and more particularly, to a device-accommodating box which enables a user to secure the box at a predetermined angle while the box is open, thus particularly being suitable for a protecting/accommodating case for a conversation machine for physically handicapped people, or the like.

Related Background Art

A typical protecting/accommodating box shown in FIGS. 5(A) and 5(B) is conventionally used for a conversation machine for physically handicapped people. FIGS. 5(A) and 5(B) show a device-accommodating box generally denoted by 10 closed and opened, respectively. The device-accommodating box 10 includes a device-accommodating portion 11, a lid 12 which freely opens and closes relative to the accommodating portion 11 by means of a hinged portion 13. The above-mentioned three members are integrally formed of, for example, a flexible resin material. In this example, the device-accommodating portion 11 and the lid 12 are formed in a box-like rectangular shape, thereby accommodating a device so as to protect it inside.

In a conventional device-accommodating box of this type, for example, a box for accommodating a conversation machine for physically handicapped people, it is desirable that the device be kept such as to be easily operated, inconveniencing the physically handicapped people as little as possible. In order to achieve this object, as shown in FIG. 5(B), the device-accommodating portion 11 is partially supported by the opened lid 12, thereby securing the surface upon which the device (not shown) is operated at a tilted angle so 10 that the device is easily operated while being kept in the accommodating portion 11.

However, in the above conventional construction of the device-accommodating box, since the device-accommodating portion 11 is extremely unstably supported by the lid 12, the accommodating portion 11 might collapse during operation and the lid might fail to function as a support. In such a case, the accommodating portion 11 must be supported by hand, instead. This could be an unbearable burden on heavily handicapped people who might even need assistance from helpers. Also, the accommodating portion can be secured at only one angle, and thus, a user cannot choose a suitably tilted angle according to the situation for the use. Further, the use of a separate part for securing the accommodating portion in the tilted state not only increases the cost but also impairs good performance of carrying the device accommodated within.

SUMMARY OF THE INVENTION

In view of the above problems, an object of the present invention is to provide a device-accommodating box suitable for accommodating, for example, a conversation machine for physically handicapped people, in which the surface upon which the accommodated device is operated is easily tilted by means of a lid so that it can be secured stably.

In order to achieve the above object, there is provided a device-accommodating box comprising pivotally hinged inside and outside lids being overlapped with each other on a device-accommodating portion for accommodating a device; the device-accommodating portion being able to be secured at different angles by combining the inside and outside lids at various degrees of pivoting.

DETAILED DESCRIPTION OF THE PREFERRED EMBODIMENTS

A detailed description will now be specifically given of embodiments with reference to the drawings.

Figure 1A:
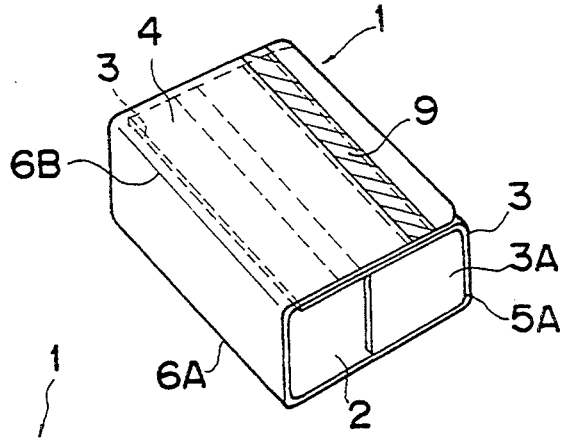
FIGS. 1(A), 1(B) and 1(C) are perspective views showing the construction of a device-accommodating box closed, half open, fully open, respectively, according to a first embodiment of the present invention.
Figure 1B:
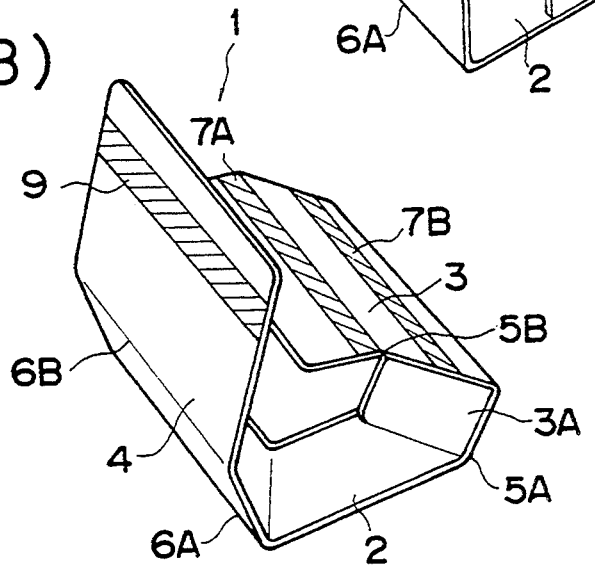
Figure 1C:
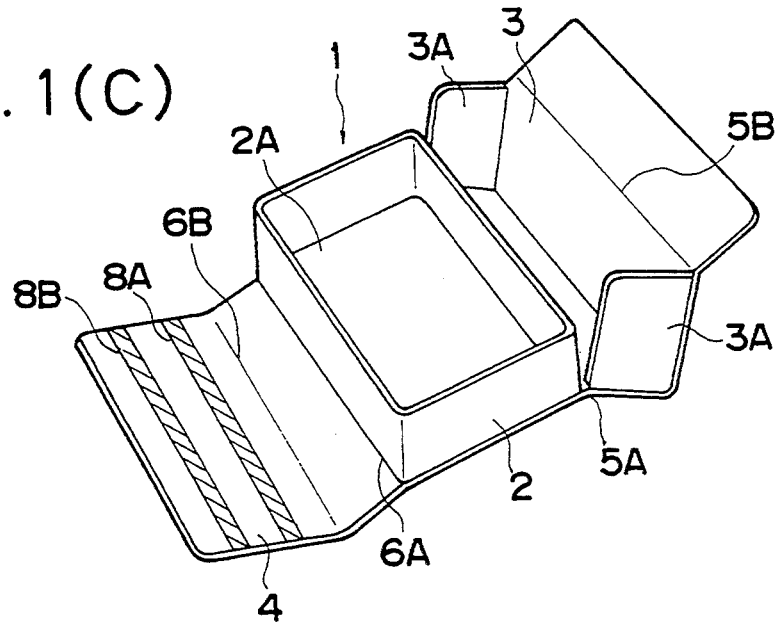
Figure 2A:
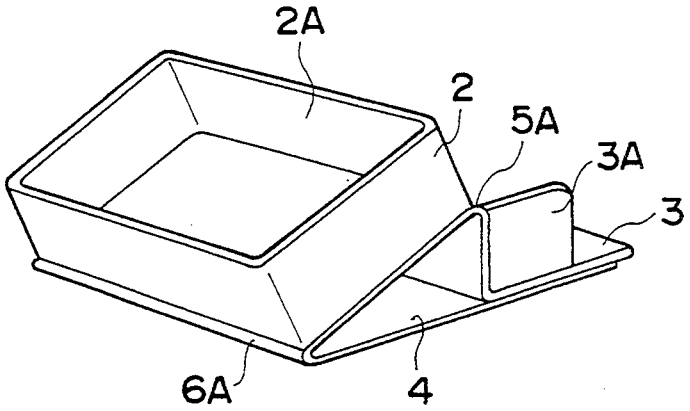
FIGS. 2(A) and 2(B) are perspective views showing the device-accommodating box tilted at two different angles according to the first embodiment of the present invention.
Figure 2B:
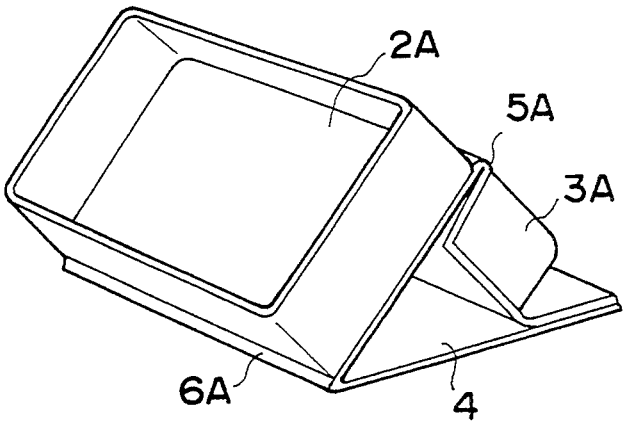

A first embodiment of the present invention is shown in FIGS. 1(A), 1(B) and 1(C) and FIGS. 2(A) and 2(B). FIG. 1(A) shows a closed device-accommodating box generally denoted by 1, more specifically, a device, for example, such as a conversation machine for physically handicapped people, accommodated and kept in the box 1. FIG. 1(B) shows the device-accommodating box 1 half opened by disengaging the lids so as to release the closed state. FIG. 1(C) shows the device-accommodating box 1 fully open. As illustrated in FIGS. 1(A) to 1(C), the device-accommodating box 1 according to the first embodiment includes an inside lid 3 and an outside lid 4 which cover a device-accommodating portion 2 by extending from the two ends of the accommodating portion 2 and folding toward an opening 2A of the portion 2.

Also, the inside lid 3 includes a first hinged portion 5A arranged between the inside lid 3 and the device-accommodating portion 2; and a second hinged portion 5B arranged on the inside lid 3; and a shoulder 3A for holding the shape of the inside lid 3 to fit the shape of the device-accommodating portion 2. The outside lid 4 includes a first hinged portion 6A disposed between the outside lid 4 and the device-accommodating portion 2; and a second hinged portion 6B disposed on the lid 4. Adhering tapes 7A and 7B (for example, magic tape [brand name]) are provided on the outside surface of the inside lid 3, and other adhering tapes 8A and 8B corresponding to the tapes 7A and 7B are provided on the inside surface of the outside lid 4, as illustrated in FIG. 1(C). Further, an adhering tape 9 is arranged on the outside surface of the outside lid 4. As will be explained below, the adhering tape 9 is engaged with at least one of the adhering tapes 7A and 7B of the inside lid 3 when the device-accommodating box 1 is open so as to secure the device-accommodating portion 2 in the tilted state.

The device-accommodating box 1 constructed as above functions as follows. When a device (not shown) accommodated in the closed box shown in FIG. 1(A) is to be used, the inside lid 3 and the outside lid 4 are disengaged, thereby exposing the opening 2A of the accommodating portion 2, as illustrated in FIG. 1(C). Subsequently, the outside lid 4 is pivoted on the first hinged portion 6A, thereby engaging the adhering tape 9 of the outside lid 4 with, for example, the adhering tape 7B of the inside lid 3. Thus, the device-accommodating portion 2 can be secured at the tilted angle shown in FIG. 2(A). Also, when it is desired that the device-accommodating portion 2 be secured at the more raised position than that shown in FIG. 2(A), the adhering tape 9 of the outside lid 4 is engaged with the adhering tape 7A of the inside lid 3, thereby securing the device-accommodating portion 2 at the tilted angle illustrated in FIG. 2(B). It is desirable that at least the hinged portions 5A, 5B, 6A and 6B be formed of a resin material having sufficient strength to resist repeated folding.

As stated above, according to the first embodiment, the inside lid 3 and the outside lid 4 are simply folded and extended, followed by opening the lid so that they can be engaged by means of the adhering tapes 7A, 7B of the inside lid 3 and the tape 9 of the outside lid 4. Hence, the device-accommodating portion 2 can be secured in a plurality of tilted states.

Figure 3A:
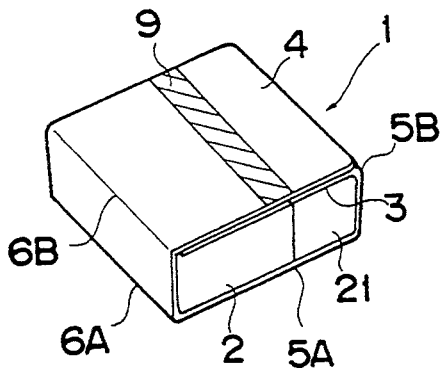
FIGS. 3(A) and 3(B) are perspective views showing the device-accommodating box closed viewed at angle 180° from each other.
Figure 3B:
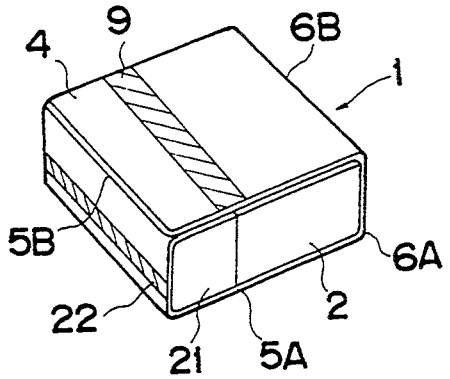
Figure 3C:
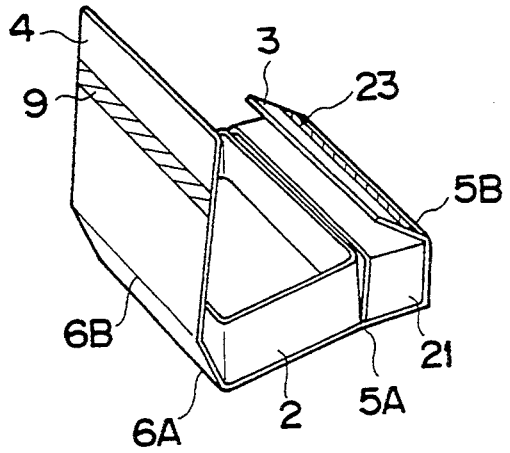
FIGS. 3(C) and 3(D) are perspective views showing the device-accommodating box half open and fully open, respectively, according to a second embodiment of the present invention.
Figure 3D:
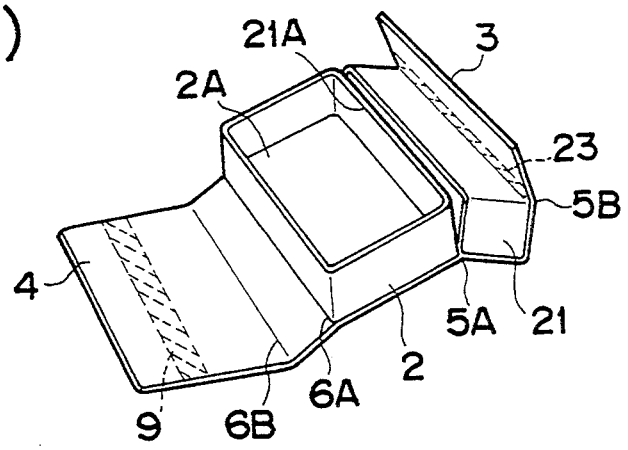

A second embodiment will now be described with reference to FIGS. 3(A) to 3(D). FIGS. 3(A) and 3(B) show the device-accommodating box 1 closed viewed from angles 180° from each other. FIG. 3(C) shows the box 1 half open by releasing the engaged state of the lids. FIG. 3(D) shows the box 1 almost entirely open. In this embodiment, an accessory accommodating portion 21 for accommodating, for example, accessories for a device, is disposed outside the device-accommodating portion 2.

As illustrated in FIG. 3(D), although an opening 21A of the accessory accommodating portion 21 is formed at 90° from the opening 2A of the device-accommodating portion 2, it may be formed in parallel to the opening 2A. In this case, however, the inside lid 3 is desirably arranged to extend slightly longer toward the opening 2A of the device-accommodating portion 2 so that it will cover the opening 21A of the accessory accommodating portion 21 which faces upward. Referring back to FIGS. 3(A) to 3(D), an adhering tape 22 is provided for the outside surface, which is the bottom surface in this embodiment, of the accessory accommodating portion 21, as illustrated in FIG. 3(B), and another adhering tape 23 is provided for the top surface of the inside lid 3, as illustrated in FIG. 3(C).

Figure 4A:
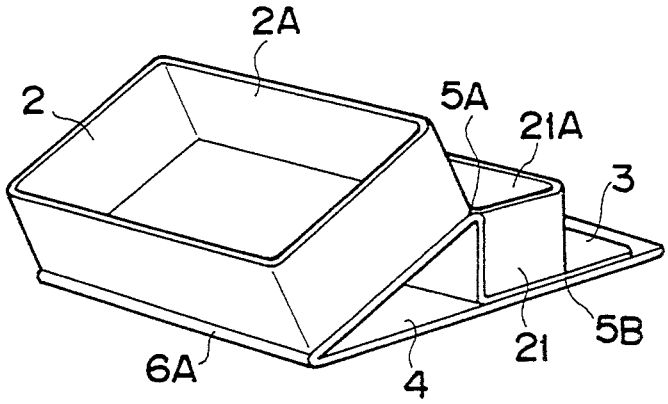
FIGS. 4(A) and 4(B) are perspective views showing the device-accommodating box tilted at two different angles according to the second embodiment of the present invention.
Figure 4B:
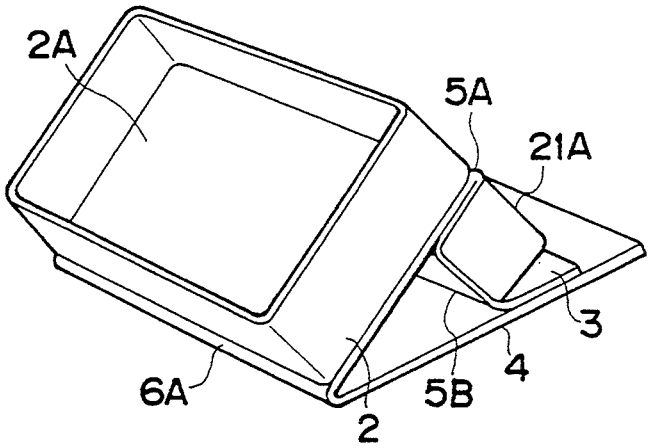
Figure 5A:
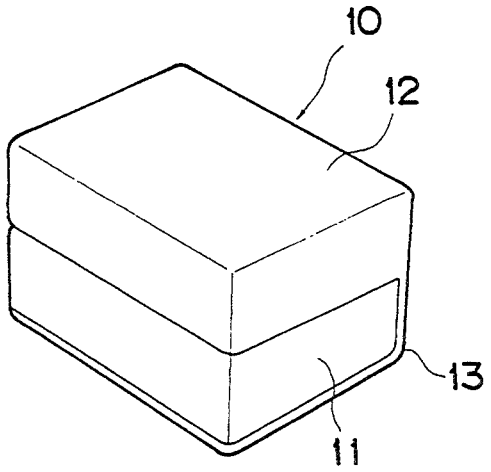
FIG. 5(A) PRIOR ART
FIGS. 5(A) and 5(B) are perspective views showing the conventional construction of a device-accommodating box closed and titled after opening the lid, respectively.
Figure 5B:
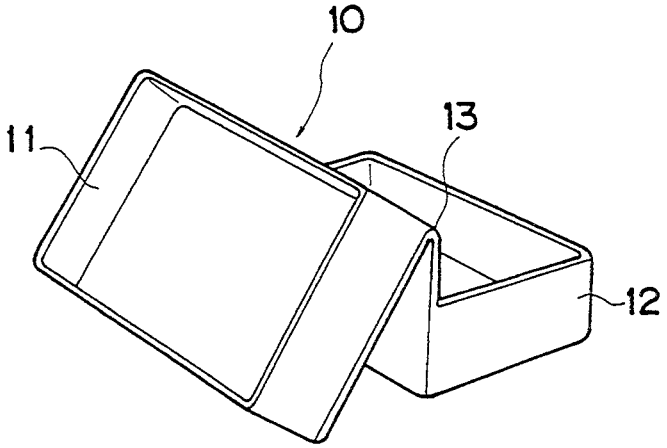
FIG. 5(B) PRIOR ART

In a manner substantially similar to the operation in the first embodiment, after the device-accommodating box 1 is opened as shown in FIG. 3(D), the adhering tape 9 arranged on the outside lid 4 is engaged with the adhering tape 23 on the inside lid 3, as shown in FIG. 4(A), and the adhering tape 9 is engaged with the adhering tape 22 on the accessary accommodating portion 21, as shown in FIG. 4(B). Thus, the device-accommodating portion 2 of the device-accommodating box 1 as constructed above can be secured in two tilted positions. Although this embodiment shows the device-accommodating portion 2 tilted at only two angles, it may be secured in more than two tilted positions by suitably determining the position and/or the number of adhering tapes provided for the inside and outside lids 3 and 4.

Further, in the above embodiments, adhering tape such as magic tape is used as adhering means for securing the device-accommodating portion 2 in the tilted states. The adhering means, however, are not limited to adhering tape, but may be any desired form, such as a combination of a receiving hole and any kind of hook or stopper claw as long as they do not stick outside so as to be an obstacle for carrying the box 1.

As will be easily understood from the foregoing description, the present invention offers the following advantages.

The device-accommodating box includes the pivotable inside and outside lids overlapped by way of hinged portions on the device-accommodating portion for accommodating a device. The device-accommodating portion can be stably secured in different tilted states by combining the inside and outside lids at various degrees of pivoting. Hence, only an extremely simple operation is required to secure the device-accommodating portion in a tilted state and also to allow a user to freely select any desired tilted angle for the use of the device-accommodating box. Moreover, a separate part is not required to secure the device-accommodating portion in the tilted state, thereby providing a device-accommodating box which is easily operated and carried at an inexpensive price.

What is claimed is:

1. A device-accommodating box comprising:

a plurality of pivotally hinged lids overlapping with each other and provided on a device-accommodating portion for accommodating a device; and first adhering means arranged on both front and both back sides of a first lid for adhering said first lid and second adhering means arranged on one side of a second lid for adhering said second lid, wherein said first adhering means on either one of said front or back sides of said first lid is engaged with said second adhering means on said second lid when said first lid is pivoted in a predetermined direction, and wherein said first adhering means on the other one of said front or back sides of said first lid is engaged with said second adhering means on said second lid said first lid is pivoted in a direction different from said predetermined direction.

2. A device-accommodating box according to claim 1, wherein said adhering means is adhering tape.

3. A device-accommodating box comprising:

a container having a device-accommodating portion for accommodating a device;

a first pivotable lid and a second pivotable lid arranged on said container; and first adhering means arranged on both front and back sides of said first lid for adhering said first lid, and second adhering means arranged on one side of said second lid for adhering said second lid, wherein said first adhering means on one of said sides of said first lid is engaged with said second adhering means on said one side of said second lid to cover said device-accommodating portion when said lid is pivoted in a predetermined direction, and wherein said first adhering means on the other side of said first lid is engaged with said second adhering means on said side of said second lid to open and display said device-accommodating portion when said first lid is pivoted in a direction different from said predetermined direction.

4. A device-accommodating box according to claim 3, wherein said second lid has a plurality of said adhering means formed thereon.

5. A device-accommodating box according to claim 4, wherein said plurality of said adhering means of said second lid are adhering tapes.

* * * * *

UNITED STATES PATENT AND TRADEMARK OFFICE

CERTIFICATE OF CORRECTION

PATENT NO. : 5,435,437

DATED : July 25, 1995

INVENTOR(S) : Sasaki

It is certified that error appears in the above-indentified patent and that said Letters Patent is hereby corrected as shown below:

COLUMN 4:

Line 46, "lid said" should read --lid when said--.

Signed and Sealed this

Nineteenth Day of December, 1995

*Attest:*

*Attesting Officer*

BRUCE LEHMAN

*Commissioner of Patents and Trademarks*